US005117537A

United States Patent [19]

Hunter et al.

[11] Patent Number: 5,117,537

[45] Date of Patent: Jun. 2, 1992

[54] REMOVABLY ATTACHABLE GROMMET DEVICE

[76] Inventors: Charles L. Hunter, 1966 Kennedy Ave.; James L. Sanderson, 4150 Saint Cloud Dr., both of Loveland, Colo. 80538

[21] Appl. No.: 666,261

[22] Filed: Mar. 8, 1991

[51] Int. Cl.[5] ..... A47C 21/00

[52] U.S. Cl. ..... 24/72.5; 24/455; 24/686; 24/67.9

[58] Field of Search ..... 24/686, 683, 685, 455, 24/72.5, 72.7, 490, 543, 545, 563, 67.9; 5/508; 135/115, 118

[56] References Cited

U.S. PATENT DOCUMENTS

| | | | |
|---|---|---|---|
| 443,006 | 12/1890 | Reuter et al. | 24/72.5 |
| 2,169,259 | 8/1939 | Lakin | 24/455 |
| 3,137,934 | 6/1964 | Rhoads | 24/67.9 |
| 3,225,408 | 12/1965 | Durham | 24/265 R |
| 3,404,435 | 10/1968 | Freundlich | 24/67.9 |
| 3,737,955 | 6/1973 | Hakim | 24/72.5 |
| 4,011,673 | 3/1977 | Levine | 24/67.9 |
| 4,541,137 | 9/1985 | Murray | 24/72.5 |
| 5,010,629 | 4/1991 | Hirzel | 24/67.9 |
| 5,014,399 | 5/1991 | Grisel | 24/72.5 |

*Primary Examiner*—Victor N. Sakran
*Attorney, Agent, or Firm*—Charles C. Corbin

[57] ABSTRACT

Disclosed is a clip device for being removably secured to a marginal edge portion of a sheet of flexible material, and having a sheet-engaging portion that extends forwardly from the rear portion of the device body, which sheet-engaging portion includes an integral tongue which projects forwardly from the device's rear portion and which is resiliently deflectable from the general plane of the device body, and the sheet-engaging portion further including a peripheral frame member which also extends forwardly from the device rear portion and having a front end with an inner edge that lies adjacent the front end of the undeflected tongue. The device has an open position in which the tongue is downwardly deflected away from a first side of the frame to provide a gap for insertion of a marginal edge portion of sheet material, and also a locked configuration to which the tongue may be urged by manipulating it through the frame member to the other side of the frame member so that the front edge of the tongue lies in close proximity to the frame front end, the clip being operative to frictionally secure sheet material between the front edge of the tongue and the frame.

20 Claims, 2 Drawing Sheets

REMOVABLY ATTACHABLE GROMMET DEVICE

BACKGROUND OF THE INVENTION

1. Field of the Invention

The present invention relates to clips for being removably fastened to the marginal edge portion of a sheet of flexible material. More particularly, the present invention relates to a removable grommet that is securable to a flexible sheet without penetrating the attached material.

2. Description of the Prior Art

Heretofore, it has been the general practice to provide sheets of flexible material, such as canvas covers and fiber-reinforced polymeric sheets and the like, with eyelets or grommets that are built in during fabrication and spaced along the sheet periphery to serve as tethering points for holding the cover in place in many well known indoor and outdoor applications.

There has arisen the need for readily converting plain flexible sheets of various sizes and material types into tetherable covers and the like by the use of grommet-like devices that can be removably secured at desired locations long the marginal edge of the sheet of material. It is further desired that such devices be attachable without having to pierce or otherwise alter the physical integrity of the material.

One prior development seeking to address this need is the removable anchor attachment device of U.S. Pat. No. 3,225,408 which employs pressure sensitive adhesive on the inner surfaces of a bifurcated anchor strap. It appears that successful use of such devices may be highly dependent on the quality of the adhesive bonding made with the sheet material, which in turn must depend on such factors as surface texture, cleanliness, dryness, ambient temperature, etc. These and other devices that rely on adhesive may also be greatly limited regarding their reusability. Another type of device which may be suitable as an attachable tie-down anchor for flexible sheet materials, and which avoids the aforementioned limitations, is disclosed in U.S. Pat. No. 4,175,305. While such device represents an improvement because it can be fastened in a non-intrusive manner, it too has drawbacks which stem primarily from the fact that two components, a male and a female, are required. With such dual piece designs there is concern for added inventory requirements, economical fabrication, versatility of application and ease of use.

SUMMARY OF THE INVENTION

The present invention was primarily developed for removably fastening grommets or eyelets to flexible covers and the like, however, it will become apparent that the invention is of broader scope and relates to a clip structure or mechanism for attachment to flexible sheet materials of various types.

In view of the aforementioned prior art shortcomings and limitations, it is a general object of the present invention to provide a removably attachable clip for a flexible sheet material, which clip can be readily utilized in a manner that does not impair the physical integrity of the material.

Another object of the present invention is to provide such a clip that can be applied to a large variety of materials.

An additional object is to provide means for easily converting a plain sheet of material into a tetherable cover.

A further object is to provide a removably attachable grommet device with a simple yet effective one-piece design.

Yet another object of the invention is to provide devices of this character having these advantages and capacities, and which are reliable and effective in operation and comparatively inexpensive to manufacture.

These and other objects and advantages will become apparent to those of ordinary skill in the art by reference to the present invention which is essentially a clip of integral construction for being removably attached to a marginal portion of a sheet of flexible material, which material can be as varied as a woven fabric and the flexible flesh of an animal's ear.

A device according to the present invention has a rear portion that may include an eyelet or other anchoring structure. However, the inventor's novel structure lies in the provision of a sheet-engaging portion that extends forwardly from the rear portion of the device. This is the clip mechanism which has two key components, the first being an integral resilient tongue that projects forwardly from the rear portion of the device and which is resiliently deflectable out of the general plane of the device body. The second component of the clip mechanism is a frame member that also extends forwardly from the device rear portion, spaced from the periphery of the tongue sides and having a forward portion with a rear edge that ordinarily lies adjacent to the front edge of the tongue and in overlapping relationship therewith. The device has an position in which the tongue forward edge lies below the frame, the tongue being resiliently urgable to an open position in which it is deflected downwardly to provide a gap for receiving an edge portion of material. It will be appreciated that the "edge" portion of flexible material that the subject device is adapted to secure, advantageously includes the edge portion found at the periphery of a sheet of material as well as the edge that may be formed at any place on the sheet when material is folded to form an edge of doubled material. The clip mechanism also has a locked position which is achieved by manipulating the tongue to the other side of the frame by bowing it in the middle to allow its front end to clear the front end of the frame. In the locked position the front edge of the tongue lies in close proximity to surfaces of the inner edge region of the front end of the frame. When a marginal portion of flexible sheet material is placed within the grasp of the clip in its open position and the clip with engaged material is resiliently urged to its locked position, the clip mechanism is operative to frictionally secure the material between tongue and frame.

One preferred embodiment of the invention includes additional integral structure for grasping the outermost edge of a sheet of material. This includes, within the rearward half of the tongue, a resilient tab that extends forwardly from the device rear portion, and which tab is framed by an opening in the tongue with sides that are spaced from the tab sides, the front of the opening having an edge that ordinarily lies adjacent the front edge of the tab. When the tongue is deflected to its open position there is provided a gap between the bottom of the tab and the tongue for receiving the outermost edge of the material to be grasped, and when the tongue is relaxed the tab may be urged into a sheet-engaging position with a material secured between the front edge of the tab and the tab frame. The tongue may then be urged to its locked configuration as described above to make primary securement of the material in the manner described above.

The accompanying drawings which form a part of the specification illustrate a preferred embodiment of the invention and together with the description serve to explain the principles of the invention.

DETAILED DESCRIPTION OF THE INVENTION

Figure 1:
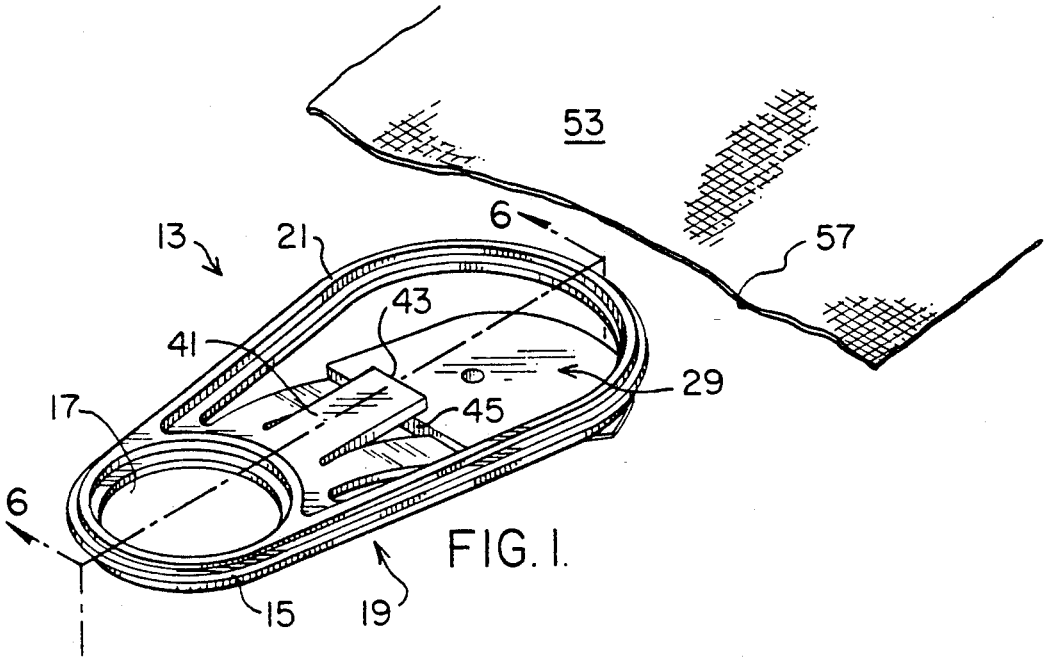
FIG. 1 is a view in perspective illustrating a preferred embodiment of a grommet device constructed according to the present invention held in an open configuration for receiving the edge portion of a sheet of material.
Figure 2:
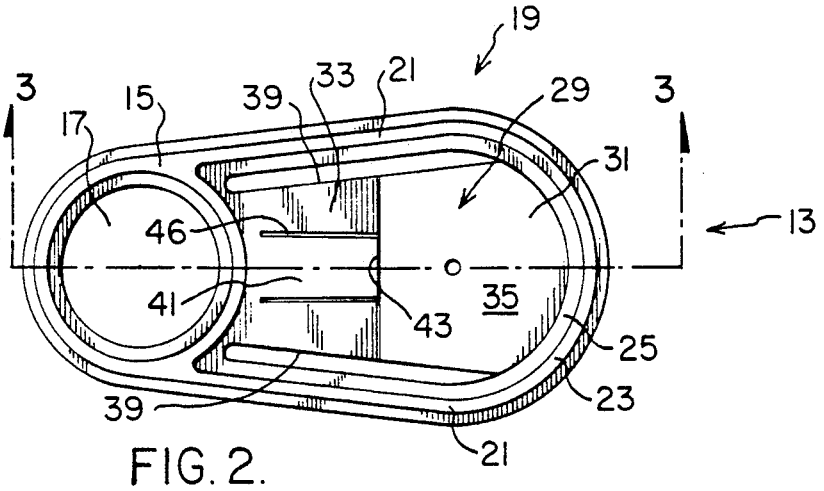
FIG. 2 is a top plan view of a grommet device according to the invention with its tongue front end below the device frame.
Figure 3:
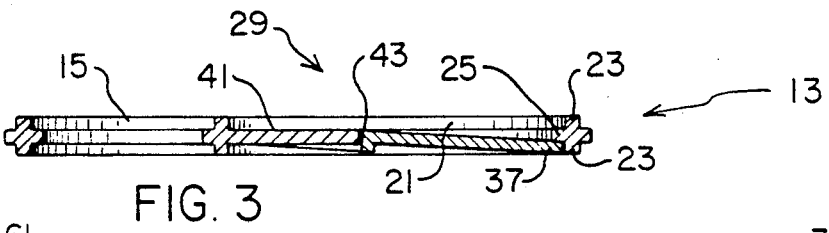
FIG. 3 is a sectional view taken along the line 3—3 of FIG. 2.

Referring now to the drawings, FIGS. 1, 2 and 3 illustrate a preferred embodiment of a grommet device 13 that has been constructed according to the principles of the present invention. It is noted that device 13 is capable of being fabricated using known techniques of the plastic molding industry, such as injection molding, and has an integral construction of polypropylene which is durable and sturdy, yet resilient. Although the preferred embodiment hereindescribed is fabricated of polypropylene it will be understood that other well-known polymeric materials having suitable properties may be employed.

Note that the body of device 13 has rear portion 15 characterized by opening 17 which serves as an eyelet that is engagable by a hook, a tie-line or other commonly available anchoring devices. It is also contemplated that rear portion 15 may be configured as a flat surface which can be color coded or stamped with information to allow device 13 to serve a tagging or flagging function. Upon further reading it will be apparent that the scope of the present invention is such that the rear portion 15 of the present invention may take on many configurations as will occur to those with ordinary skill in the art, the essence of the invention lying in the combining of the device rear portion with the forward portion which embodies a unique fastening structure as will be described.

Figure 6:
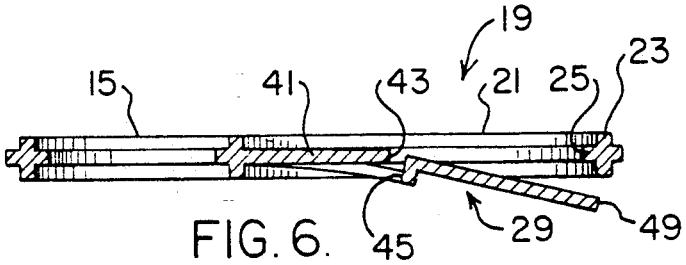
FIG. 6 is a sectional view taken along line 6—6 of FIG. 1.

Lying forwardly of the rear portion 15 is the featured clip portion 19 which includes a frame member 21. Note that the sectional views of FIGS. 3 and 6 show in cross-section that the preferred structure of both rear portion 15 and frame member 21 is characterized by vertical and horizontal ribs to give desired strength, rigidity, and material efficiency to these components, and with ribs 23 and 25 on the curved forward part of the frame 21 serving an additional function in the operation of device 13 in a manner that will be described hereinafter.

The other main component of the clip portion 19 of device 13 is the tongue 29 which FIGS. 2 and 3 show in an initial relaxed position lying in the same general plane as frame 21 with the curved front end of tongue 29 lying adjacent the lower side of rib 25 as FIG. 3 best shows. Tongue 29 is designed to be resiliently deflectable downwardly away from frame 21 so that it may be held in an open position as depicted in FIGS. 1 and 6. It is also contemplated that a variant of the invention has a tongue identical to tongue 29 but having an initial relaxed position resembling the open position shown in FIG. 6. Note that tongue 29 has a forward major portion 31 and a rearward portion 33, with the major portion 31 having a flat upper surface 35 and featuring a curved front end 37 which lies in overlapping relationship with the rib 25 as FIG. 3 shows. Also note that the sides 39 of tongue 29 are spaced from frame member 21. It will be seen that the size of this spacing is such as to receive flexible sheet material in a nonbinding manner when device 13 is attached to such material in a way that will be described. FIG. 2 shows that the rearward portion of tongue 29 features a tab 41 with a front edge 43 that ordinarily lies in close proximity to a rearwardly facing edge 45 provided by the tongue portion 31. The openings 46 on both sides of tab 41 provide spacing sufficient to receive material in a nonbinding manner. FIGS. 1 and 6 show that when tongue 29 is downwardly deflected tab 41 remains straight with its edge 43 sufficiently separated from the tongue opening edge 45 to create a gap in which a leading edge of material may be inserted. It will be see that when tab edge 43 and opening edge 45 are brought together they will be operative to frictionally secure material therebetween. Thus it will be appreciated that the spacing between these edge portions will be selected to suit the properties of the material to be grasped by the device 13. In the case of comparatively thick flexible sheet material, the tab 41, with material, may be downwardly deflected to a securement position in which its edge 43 lies below the opening edge 45.

Figure 5:
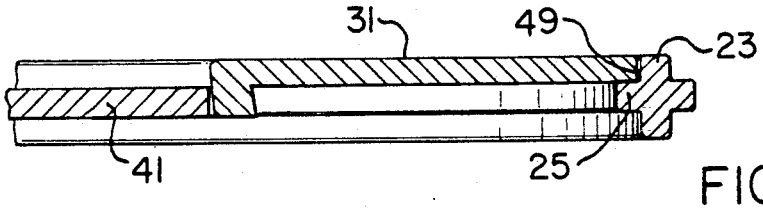
FIG. 5 is an enlarged fragmentary sectional view taken along the line 5—5 of FIG. 4.

Tongue 29 may be moved from the initial position shown in FIG. 3 to a locked position depicted in FIG. 5 by pressing upwardly on the midportion of tongue 29 to resiliently bend it sufficiently to shorten its effective length so as to allow the tongue front end to move upwardly over the rib 25 to the other side of the frame 21. For illustration purposes FIG. 5 depicts tongue 29 in its locked position without engaged material, and with its lower surface lying adjacent the top of rib 25 and with the front edge 49 spaced closely from the rear surface of rib 23. It will be appreciated that this spacing is selected according to the properties of the material 13 to be grasped, these properties including thickness, flexibility and surface smoothness.

Figure 9:
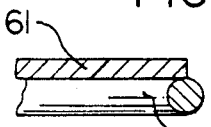
FIG. 9 is a fragmentary, enlarged sectional view illustrating a variant of the present invention that has a frame with a circular cross-section.
Figure 10:
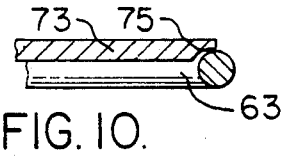
FIG. 10 is another fragmentary, enlarged sectional view illustrating still another variant that has a frame with a circular cross-section.
Figure 4:
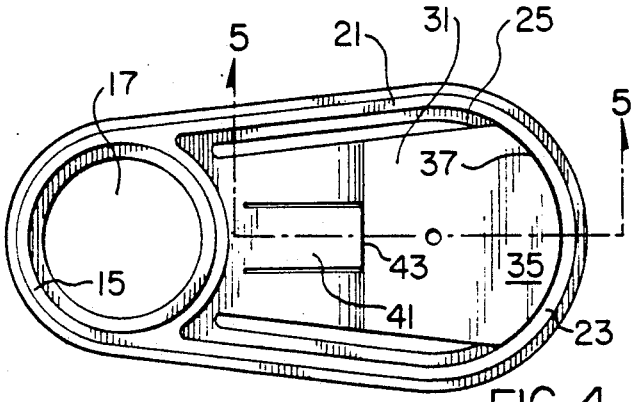
FIG. 4 is a top plan view showing the preferred embodiment in its locked configuration.
Figure 7:
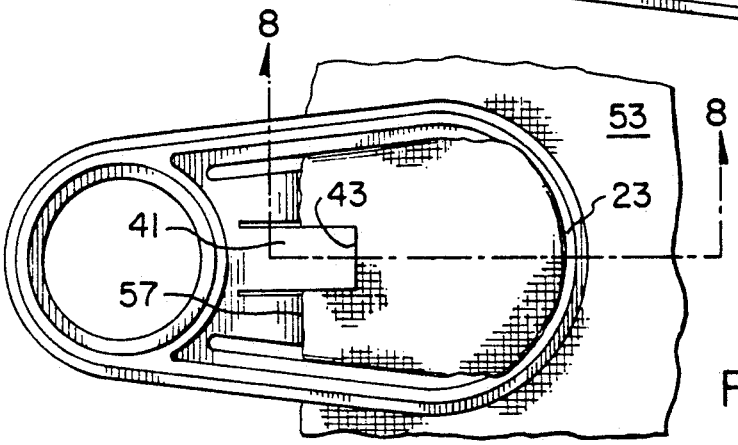
FIG. 7 is a plan view illustrating the preferred embodiment secured to an edge portion of a sheet of material.

While in the preferred embodiment hereindescribed the frame 21 has a cross-shaped cross-sectional configuration, variants of the invention may be constructed with a frame having a circular configuration. FIG. 9 is illustrative of one such variant and shows a locked configuration with tongue 61 lying adjacent frame forward portion 63. In a similar variant shown in FIG. 10, the tongue 73 is radiused at 75. It will be seen that such variants of the invention can be particularly adept at being attached to material which is relatively thick.

The working principles of the preferred embodiment are demonstrated in the following description of the manner in which device 13 is advantageously applied to a selected marginal edge portion of a sheet of flexible sheet material 53. Reference to FIGS. 1 and 6 show device 13 with tongue 29 in its open position. These figures also show that there is a gap between the lock tab 41 and the deflected tongue. The outermost edge 57 of material 53 may be moved through the gap between tongue and frame and inserted in the gap below tab 41. Tongue 29 may then be relaxed and moved towards its initial position. Then the tab 41, carrying material with it may be positioned with its edge 43 lying adjacent the rearward facing edge 45, which alignment causes the material to frictionally bind between these edges. This frictional bind holds the material when it is tugged forwardly relative to device 13, and is enhanced by virtue of holding the material at a sharp bend around the top of edge 45.

Figure 8:
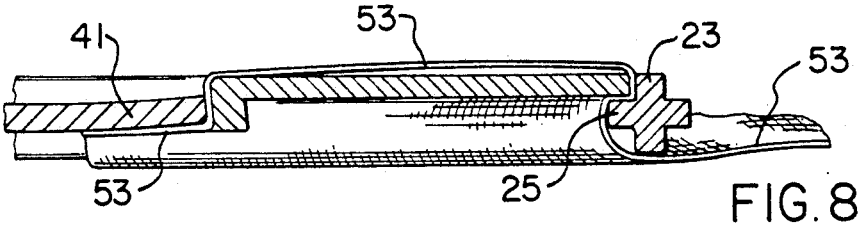
FIG. 8 is an enlarged fragmentary sectional view taken along the line 8—8 of FIG. 7.

With the outermost edge 57 secured in this manner a marginal edge portion of sheet 53 will lie generally flatly against the tongue flat upper surface 35. Full securement of sheet 53 will then be achieved by bending and pushing the tongue with entrained material upwards to the upper side of frame 21. Then finally, the securement operation is completed when the tongue front end is pushed downwardly towards its previously described locked position. FIG. 8 shows material compressed between the outer edge 49 and rib 23. Material 53 is also pressed between the bottom of tongue 29 and the rib 25. This positioning causes material 53 to undergo a first sharp bend around the top corner of edge 49 and a second bend around the lower corner of edge 49, the material 53 making a final bend around the edges of rib 25. When the device 13 and material 53 are tugged in opposite directions the aforedescribed bending engagements will enhance the frictional hold on the material 53. The frictional pull on the tongue edge by the taut material will also help to pull the tongue towards, and hold it in, its locked configuration. Moreover, it is further noted that by virtue of the outermost edge 57 being held by tab 41, material is held generally flat against tongue surface 35 which helps to hold material 53 wrapped around the tongue edge as desired for maximum frictional grasp.

Device 13 may be quickly and easily removed from sheet 53 when it is desired. In order to do this the tongue 29 is bowed downwardly at its midportion and snapped to the lower side of frame 21. The leading edge of sheet 53 may then be freed by deflecting tab 41 upwardly with respect to tongue 29.

While a particular embodiment of the invention has been described herein it is not intended that the invention be limited thereto, since various modifications and changes may readily occur to those skilled in the art without departing from the invention. For example, a variant under the invention may have a tongue with a straight edge rather than a curved edge as in the described embodiment. Therefore, it is aimed to cover all such changes and modifications as fall within the true spirit and scope of the invention as described in the claims which follow.

We claim:

1. Clip device for being removably attached to an edge portion of a sheet of flexible material, comprising:

a) rear portion;

b) forward portion including a pivotally mounted resilient tongue having sides and a front edge, and projecting forwardly from said rear portion and integrally connected thereto, and a frame member that extends forwardly from said rear portion and having a pair of laterally spaced apart side arms and a front end, each said side arm spaced from an adjacent one of said tongue sides, the front edge of said tongue adapted to lie adjacent to and in overlapping relationship with said frame front end; said tongue having an initial position in which the front edge of said tongue lies below said frame front end, said tongue being downwardly deflectable to create a gap between said tongue and said frame, in which gap said edge portion of sheet material can be received; and said tongue being resiliently bowable to shorten the distance between the front edge of said tongue and said device rear portion, sufficiently to allow said forward end to clear said frame front end to allow manipulation of said tongue from said initial position to a locked position in which said tongue front edge lies adjacent an upper surface of said frame front end and in overlapping relationship therewith, wherein said device is operative, when said tongue with said material engaged thereover is moved from said initial position to said locked position, to frictionally secure said material around said tongue front edge.

2. Device as defined in claim 1 wherein said tongue forward end has an edge which has a curbed configuration in plan view.

3. Device as defined in claim 1 wherein said tongue forward end has a generally flat upper surface and generally flat lower surface and said forward end has a flat edge surface that lies at about 90 degrees to said lower and upper surfaces.

4. Device as defined in claim 1 wherein said tongue forward end has a generally flat front edge surface.

5. Device as defined in claim 4 wherein said frame front end has a circular cross-sectional configuration.

6. Device as defined in claim 4 wherein said tongue has a front edge with sharp upper and lower corners.

7. Device as defined in claim 4 wherein said tongue forward end has a generally flat lower surface and said frame front end includes a generally flat upper surface to which said tongue lower surface is adapted to lie adjacent when said tongue is in its locked configuration.

8. Device as defined in claim 7 wherein said frame front end includes a generally upright surface and wherein the front edge surface of said tongue lies adjacent said upright surface when said tongue is in its locked configuration.

9. Device as defined in claim 8 wherein said tongue front edge surface lies generally parallel to said upright surface when said tongue is in its locked configuration.

10. Device as defined in claim 8 wherein said tongue front edge engages said upright surface when said tongue is in its locked position.

11. Device as defined in claim 7 wherein said frame front end has a vertical rib and a horizontal rib, and said vertical rib provides said upright surface and said horizontal rib provides said generally flat upper surface.

12. Device as defined in claim 11 wherein said horizontal rib has a rearwardly facing wall with an upper corner having a sharp bend.

13. Device as defined in claim 8 wherein said device is operative, when said tongue is in its locked position, to compress said material between said tongue front edge surface and said frame upright surface.

14. Device as defined in claim 1 wherein said frame front end has a cross-shaped cross-sectional configuration.

15. Device as defined in claim 1 wherein said frame front end has a circular cross-sectional configuration.

16. Device as defined in claim 15 wherein the lower surface of said tongue forward end has a curvature which generally complements said circular cross-sectional configuration.

17. Device as defined in claim 1 wherein said frame sidearms are spaced from said tongue sides for a distance sufficient to receive said material in a non-binding manner.

18. Device as defined in claim 1 including an integral tab extending forwardly from said rear portion and lying within a major rearward portion of said tongue, said tongue rearward portion providing a frame-like opening with opposing sides spaced from the sides of said tab, and said tab having a front edge that lies in close proximity to an edge of said framelike opening, whereby said tongue is downwardly deflectable to create a gap between the underside of said tab and said downwardly deflected tongue.

19. Device as defined in claim 18 wherein said device is operative to frictionally secure a leading edge of said material between the front edge of said tab and said frame.

20. Device as defined in claim 18 wherein said opposing sides of said frame-like opening are spaced from said tab sides by a distance sufficient to receive said material in a non-binding manner.

* * * * *